US010644435B2

(12) United States Patent
Oomori

(10) Patent No.: US 10,644,435 B2
(45) Date of Patent: May 5, 2020

(54) WATERPROOF CONNECTOR

(71) Applicant: Sumitomo Wiring Systems, Ltd., Yokkaichi, Mie (JP)

(72) Inventor: Hiroyuki Oomori, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/292,656

(22) Filed: Mar. 5, 2019

(65) Prior Publication Data

US 2019/0296480 A1 Sep. 26, 2019

(30) Foreign Application Priority Data

Mar. 22, 2018 (JP) ..... 2018-053825

(51) Int. Cl.
*H01R 13/52* (2006.01)
*H01R 13/422* (2006.01)

(52) U.S. Cl.
CPC ..... *H01R 13/5205* (2013.01); *H01R 13/422* (2013.01); *H01R 13/5213* (2013.01)

(58) Field of Classification Search
None
See application file for complete search history.

(56) References Cited

U.S. PATENT DOCUMENTS 4,690,478 A * 9/1987 Rahrig ..... H01R 13/521 439/271
4,804,343 A * 2/1989 Reedy ..... H01R 33/06 439/318
4,832,616 A * 5/1989 Stein, Sr. ..... H01R 13/5205 439/279
5,066,242 A * 11/1991 Martucci ..... H01R 13/5221 439/281
5,098,315 A * 3/1992 Scowen ..... H01R 13/5221 439/587
5,573,429 A * 11/1996 Miyazaki ..... H01R 13/5205 439/587
5,890,927 A * 4/1999 Yashima ..... H01R 13/5208 439/587
8,430,696 B2 * 4/2013 Matsumoto ..... H01R 13/426 439/271
2005/0227535 A1 * 10/2005 Holman ..... H02G 3/088 439/587
2012/0289086 A1 * 11/2012 Jetton ..... H01H 85/0026 439/587

FOREIGN PATENT DOCUMENTS

JP 3386384 3/2003

* cited by examiner

*Primary Examiner* — Tho D Ta
(74) *Attorney, Agent, or Firm* — Gerald E. Hespos; Michael J. Porco; Matthew T. Hespos

(57) ABSTRACT

A housing (10) includes a terminal accommodating portion (18) capable of accommodating a terminal fitting (80), a rubber plug accommodating portion (19) communicating with the terminal accommodating portion (18) and capable of accommodating a rubber plug (70), and two housing locks (23) on both sides across the rubber plug accommodating portion (19). Escape of the rubber plug (70) from the rubber plug accommodating portion (19) is restricted by a cover (40) including a wire insertion hole (43). The cover (40) includes two cover locks (46) lockable to the housing locks (23) and a wire insertion opening (44) located between the cover locks (46) and formed by cutting a circumferential part from an outer peripheral surface to the wire insertion hole (43).

8 Claims, 11 Drawing Sheets

WATERPROOF CONNECTOR

BACKGROUND

Field of the Invention

The invention relates to a waterproof connector.

Related Art

Japanese Patent No. 3386384 discloses a waterproof shield connector. A terminal fitting is connected to an end part of a shielded wire, and a rubber plug is held in close contact with the outer peripheral surface of the shielded wire. The connector further has a housing with a terminal accommodation chamber capable of accommodating the terminal fitting, an opening capable of accommodating the rubber plug and a pressing portion for restricting the escape of the rubber plug from the opening. The pressing portion is held in the connector housing via an unillustrated locking mechanism.

The rubber plug and the pressing portion are mounted on the shielded wire in advance. The terminal fitting is connected to the end part of the shielded wire and is inserted into the terminal accommodation chamber. Thereafter, the rubber plug is press-fit into the opening of the connector housing, and the pressing portion is fit into an end part of the connector housing.

The pressing portion needs to be inserted on the shielded wire in advance. Thus, a work procedure is limited and an operation may become cumbersome.

The invention was completed on the basis of the above situation and aims to provide a waterproof connector capable of improving assembling efficiency.

SUMMARY

The invention is directed to a waterproof connector with a terminal fitting to be connected to an end part of a wire. A rubber plug closely contacts an outer peripheral surface of the wire. The waterproof connector also has a housing with a terminal accommodating portion that can receive the terminal fitting. The housing also has a rubber plug accommodating portion communicating with the terminal accommodating portion and capable of receiving the rubber plug. Two housing locks are on both sides across the rubber plug accommodating portion. The connector further has a cover configured to restrict escape of the rubber plug from the rubber plug accommodating portion. The cover includes a wire insertion hole and two cover locks that can lock to the housing locks. A wire insertion opening is formed in the cover between the cover locks and is formed by cutting a circumferential part from an outer peripheral surface to the wire insertion hole.

Since the cover includes the wire insertion opening formed by cutting the circumferential part, the wire can inserted into the wire insertion hole of the cover through the wire insertion opening, for example, after the terminal fitting connected to the end part of the wire is inserted into the terminal accommodating portion of the housing. Thus, it is not necessary to perform a cumbersome operation of inserting the wire into the wire insertion hole of the cover in the axial direction. Further, an assembling operation of the cover can be performed at any stage. Therefore, assembling efficiency is improved.

The cover lock may be a lock piece having a lock hole between extending portions extending in an axial direction of the wire insertion hole, and the housing lock may be a lock projection to be fit into the lock hole. Additionally, the housing may include housing lock holding portions that contact the extending portions along the axial direction. If the wire pulled out from the wire insertion hole of the cover vibrates, a vibration force may be transmitted to the cover and locking between the cover locks and the housing locks could be released inadvertently. However, in the above configuration, the housing lock holding portions respectively contact the extending portions of the cover locks along the axial direction. Thus, even if vibration of the wire is transmitted to the cover, a state where the lock projections are fit in the lock holes of the cover locks can be maintained and locking between the cover locks and the housing locks will not be released inadvertently.

The cover may include cover lock holding portions that sandwich the housing lock holding portions between the extending portions and the cover lock holding portions. Additionally, the cover lock holding portions contact the housing lock holding portions from a side opposite to the extending portions along the axial direction. The housing lock holding portions are sandwiched between the extending portions of the cover locks and the cover lock holding portions such that the cover is held more stably on the housing. As a result, the cover will not be detached inadvertently from the housing.

A flange may protrude from the rubber plug in a direction perpendicular to the axial direction, and the cover may include a body configured to sandwich the flange between an opening edge of the rubber plug accommodating portion in the housing and the body. The flange of the rubber plug is sandwiched between the body of the cover and the housing such that a resilient reaction force is applied from the rubber plug to the cover in a direction separating from the housing. Thus, the cover locks are locked firmly to the housing locks and the cover is held stably on the housing. Further, the flange closely contacts an opening edge of the rubber plug accommodating portion in the housing so that high-pressure washing water and the like will not intrude into the rubber plug accommodating portion.

The wire insertion hole of the cover has an opening diameter larger than an outer diameter of the wire. According to this configuration, wires having different diameters can be inserted through the wire insertion hole and the cover can be used commonly used.

Two facing surfaces on the wire insertion opening of the cover are inclined to widen an interval between the facing surfaces from the side of the wire insertion hole to an outer peripheral surface of the cover. The facing surfaces guide the wire and inserting the wire into the wire insertion opening of the cover can be performed smoothly.

DETAILED DESCRIPTION

Figure 1:
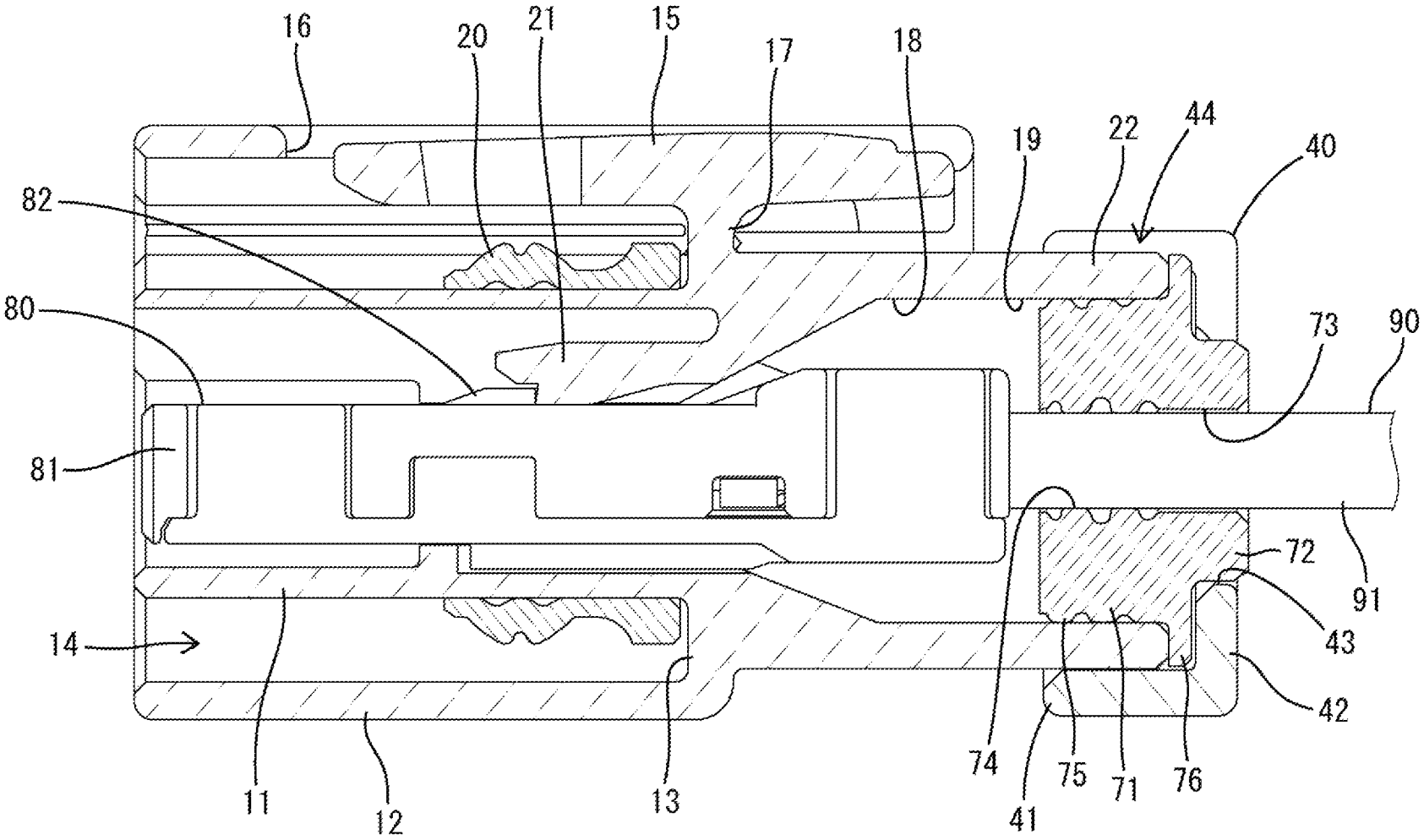
FIG. 1 is a section of a waterproof connector of one embodiment of the invention.

One embodiment is described with reference to FIGS. 1 to 14. A waterproof connector according to this embodiment is a shield connector for an automotive vehicle and separately includes a shielded wire 90, a terminal fitting 80, a rubber plug 70, a housing 10 and a cover 40. The housing 10 is to be connected to an unillustrated mating connector. Note that, in the following description, a surface side (left side of FIG. 1) of the housing 10 facing a mating housing at the start of connection is referred to as a front concerning a front-rear direction, and a vertical direction is based on figures except FIGS. 4, 6, 8 and 13.

Although not shown in detail, the shielded wire 90 is formed such that a shield layer collectively covers the outer peripheries of two coated wires and a sheath 91 covers the outer periphery of the shield layer. At an end part of the shielded wire 90, the sheath 91 is removed and the shield layer is folded back onto the sheath 91. The two coated wires exposed from the shield layer have end parts untwisted, are branched in parallel in the terminal fitting 80, and are connected to an inner conductor to be described later.

Although not shown in detail, the terminal fitting 80 is composed of an inner conductor made of conductive metal, an outer conductor 81 made of conductive metal, having the shield layer connected thereto and configured to cover the outside of the inner conductor, and a dielectric made of synthetic resin and interposed between the inner conductor and the outer conductor 81. As shown in FIG. 1, the outer conductor 81 constitutes the outer contour of the terminal fitting 80 and includes a claw-like locking projection 82 on an upper surface.

Figure 11:
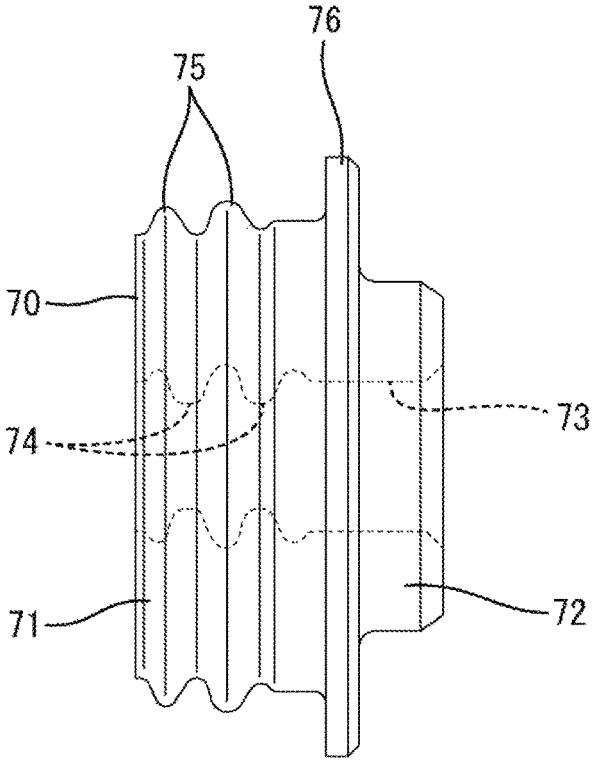
FIG. 11 is a side view of the rubber plug.

The rubber plug 70 is made of rubber, such as silicon rubber, has a hollow cylindrical shape and includes, as shown in FIG. 11, a rubber plug body 71 thick in a radial direction. A projection 72 projects rearward from a central part of the rear surface of the rubber plug body 71 and is thinner than the rubber plug body 71 in the radial direction. The outer peripheral surface of the projection 72 has a diameter smaller than that of the rubber plug body 71, and an outer peripheral part of the rear surface of the rubber plug body 71 is formed to be flat along the radial direction. A sealing hole 73 penetrates a central part of the rubber plug 70 over the entire length from the rubber plug body 71 to the projection 72.

Inner peripheral lips 74 are arranged in the front-rear direction on the inner peripheral surface of the sealing hole 73 and outer peripheral lips 75 are arranged in the front-rear direction on an outer peripheral surface.

As shown in FIG. 1, the shielded wire 90 is inserted through the sealing hole 73 of the rubber plug 70. Each inner peripheral lip 74 of the rubber plug body 71 is held in close contact with the sheath 91 of the shielded wire 90 to provide liquid-tight sealing between the shielded wire 90 and the rubber plug 70. Note that the sealing hole 73 on the side of the projection 72 has a slightly larger opening diameter than an outer diameter of the sheath 91 of the shielded wire 90.

Figure 10:
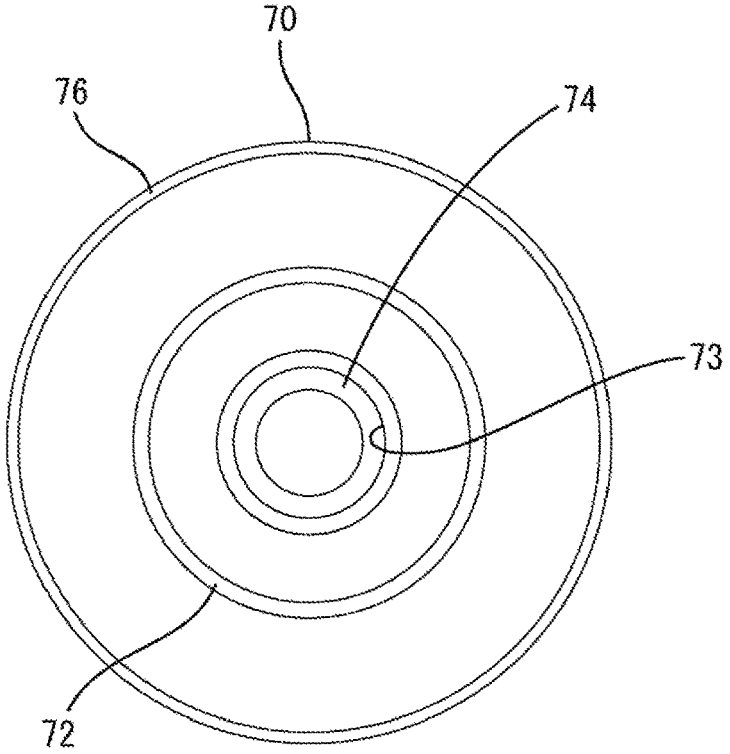
FIG. 10 is a back view of a rubber plug.

As shown in FIGS. 10 and 11, the rubber plug body 71 includes a flange 76 protruding out in the radial direction (direction perpendicular to the axial direction) on a rear end part. The flange 76 is located behind the outer peripheral lips 75 and the rear surface thereof is continuous and flush with an outer peripheral part of the rear surface of the rubber plug body 71. The outer periphery of the flange 76 has a circular shape and constitutes an outermost diameter part of the rubber plug 70.

Figure 2:
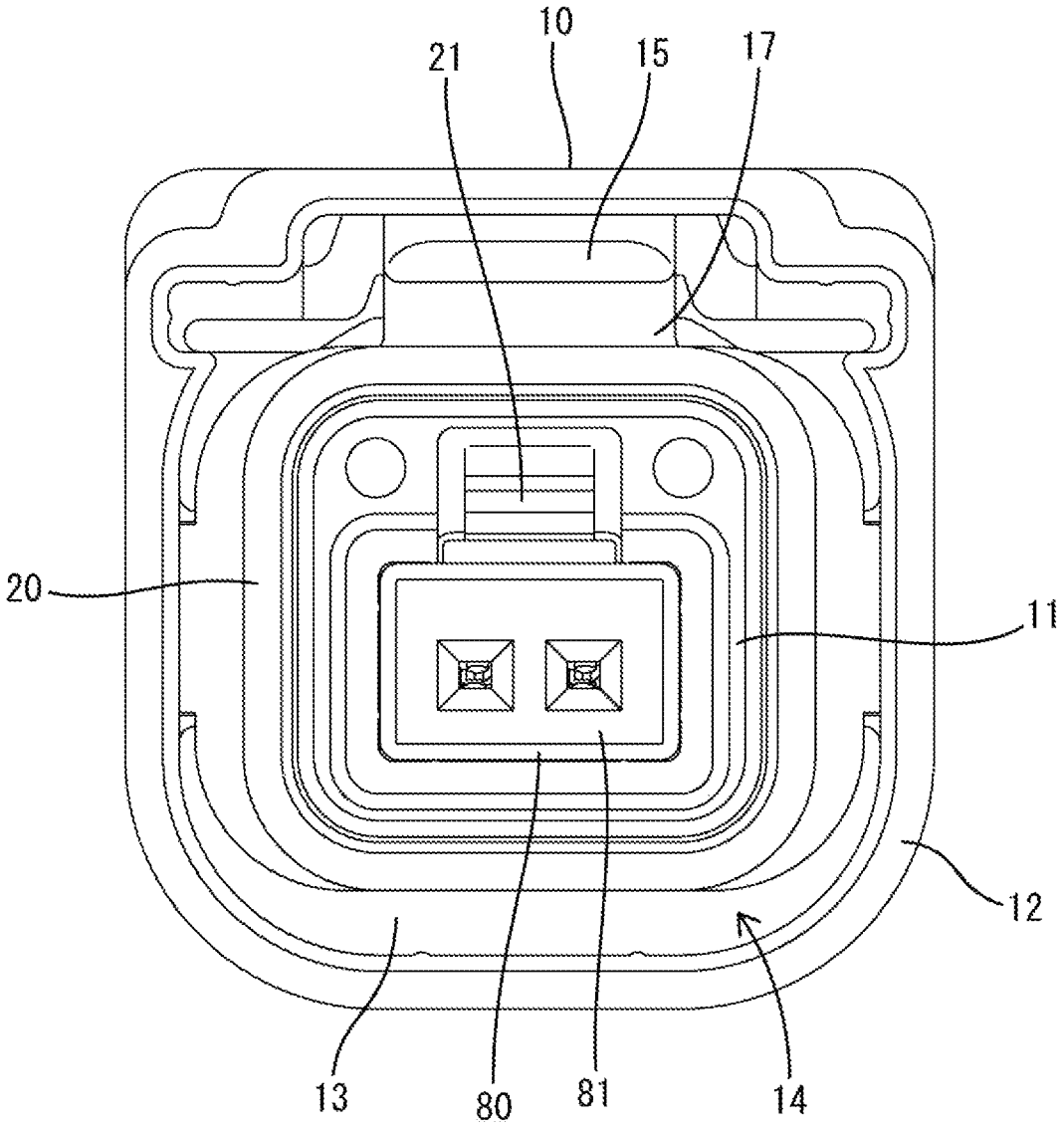
FIG. 2 is a front view of the waterproof connector.

The housing 10 is made of synthetic resin and includes, as shown in FIGS. 1 and 2, a tubular housing body 11, a fitting tube 12 surrounding the outer periphery of the housing body 11 and a radially extending coupling 13 coupling the fitting tube 12 and the housing body 11. An open connection space 14 is between the fitting tube 12 and the housing body 11 and before the coupling 13 to receive a receptacle of an unillustrated mating connector.

Figure 8:
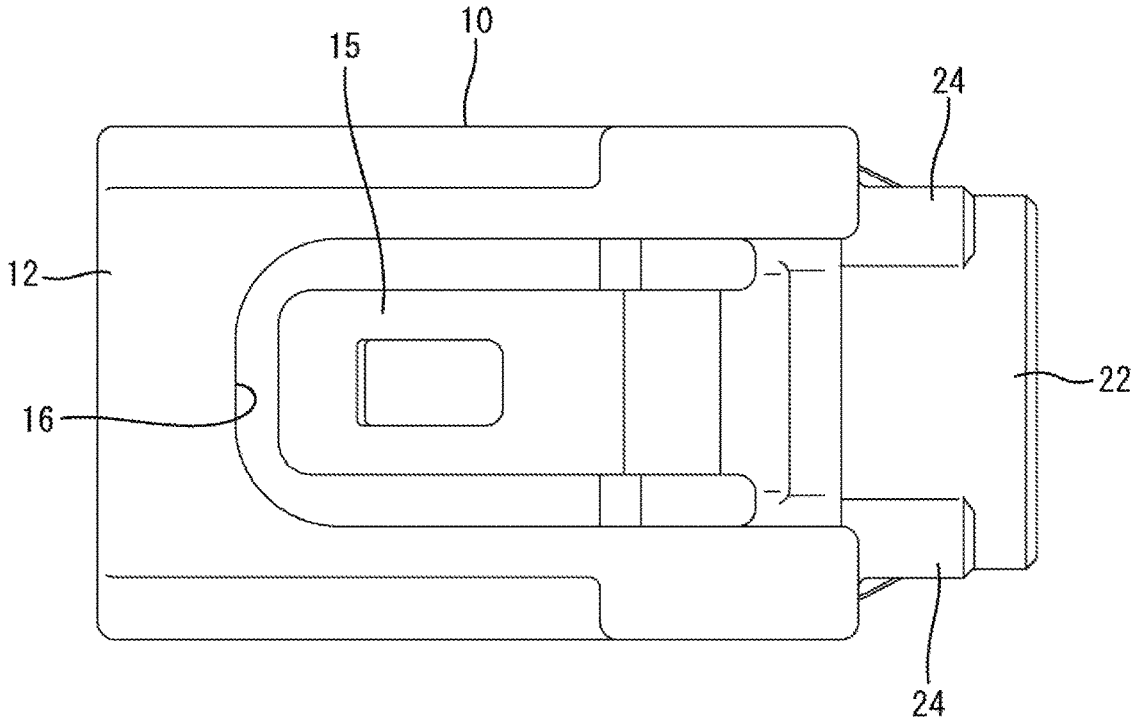
FIG. 8 is a plan view of the housing.

A lock arm 15 projects on the upper surface of the housing body 11 and is deflectable in the vertical direction. The lock arm 15 functions to hold the connectors in a connected state by locking the receptacle of the unillustrated mating connector fit into the connection space 14. As shown in FIG. 8, an upper part of the fitting tube 12 has an opening 16, and the lock arm 15 is exposed through the opening 16. As shown in FIG. 1, a base part 17 of the lock arm 15 is at the same position as the coupling 13 in the front-rear direction. A seal ring 20 is fit in front of the coupling 13 on the outer peripheral surface of the housing body 11. The seal ring 20 is sandwiched resiliently between the receptacle of the unillustrated mating connector and the housing body 11, thereby sealing between the connectors in a liquid-tight manner.

As shown in FIG. 1, the housing body 11 includes a terminal accommodating portion 18 extending in the front-rear direction and a rubber plug accommodating portion 19 behind the terminal accommodating portion 18. A vertically deflectable locking lance 21 is cantilevered forward from the upper surface of an inner wall of the terminal accommodating portion 18 at a position overlapping the base part 17 of the lock arm 15 in the front-rear direction. The terminal fitting 80 is inserted into the terminal accommodating portion 18 of the housing body 11 from behind. The locking lance 21 interferes with the locking projection 82 as the terminal fitting 80 is inserted into the terminal accommodating portion 18 and deflects. The locking lance 21 resiliently returns as the terminal fitting 80 is inserted properly into the terminal accommodating portion 18, and a tip of the locking lance 21 contacts the rear surface of the locking projection 82. The rubber plug body 71 fit on the shielded wire 90 connected to the terminal fitting 80 is inserted in a rear part of the rubber plug accommodating portion 19 when the terminal fitting 80 is inserted properly in the terminal accommodating portion 18.

Figure 7:
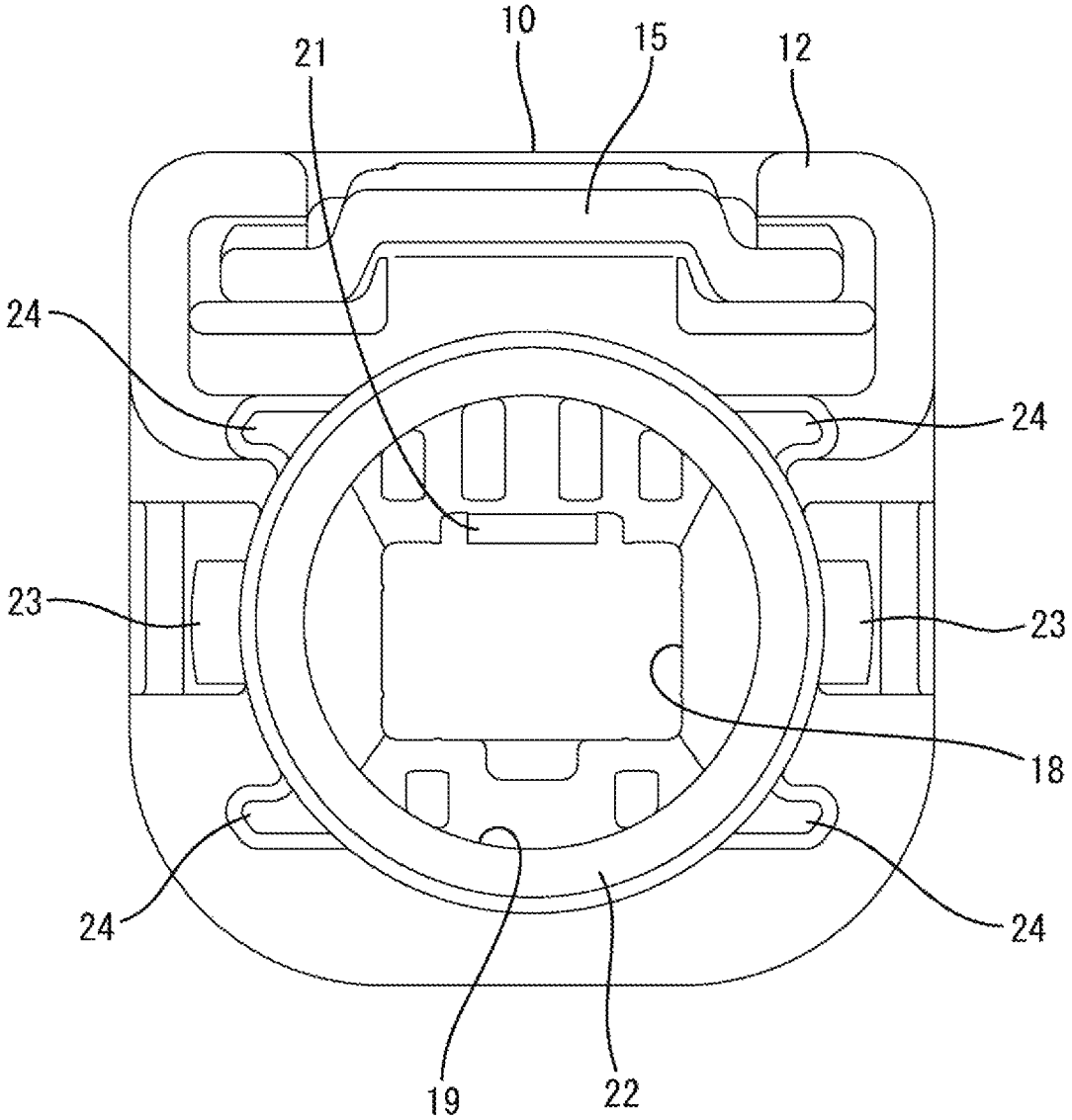
FIG. 7 is a back view of a housing.

The rubber plug accommodating portion 19 has a circular cross-section, as shown in FIG. 7, and each outer peripheral lip 75 of the rubber plug body 71 is held in close contact with an inner peripheral surface, as shown in FIG. 1. In this way, liquid-tight sealing is provided between the housing 10 and the rubber plug 70.

As shown in FIG. 7, a rear part of the housing body 11 forms a hollow cylindrical cover mounting portion 22 and defines the rubber plug accommodating portion 19. The cover mounting portion 22 includes two claw-shaped housing locks 23 on outer surfaces of both left and right sides in the radial direction across the rubber plug accommodating portion 19. Each housing lock 23 is in a vertically central part of the cover mounting portion 22. The front surface of each housing lock 23 is arranged along the vertical direction, while the rear surface is inclined forward. Further, the upper and lower surfaces of each housing lock portion 23 are arranged along the front-rear direction.

Figure 9:
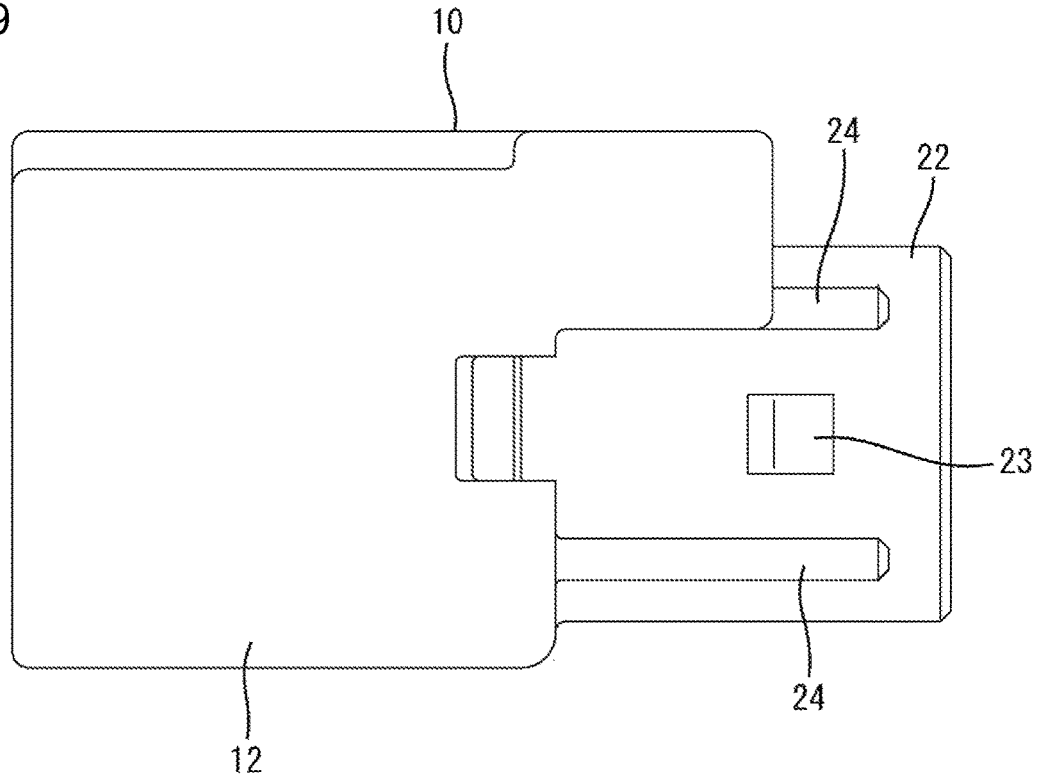
FIG. 9 is a side view of the housing.

Further, as shown in FIG. 7, the cover mounting portion 22 includes two housing lock holding portions 24 on upper and lower sides (both circumferential sides) of each housing lock 23 on each of the left and right outer surfaces. As shown in FIG. 9, each housing lock holding portion 24 is a rib extending in the front-rear direction. A front end of each housing lock holding portion 24 is connected to the rear end of the fitting tube 12 and the coupling 13, while the rear end thereof substantially aligns with the vicinity of the rear end of the cover mounting portion 22. Upper and lower surfaces of each housing lock holding portion 24 are flat surfaces arranged along the front-rear direction.

Figure 3:
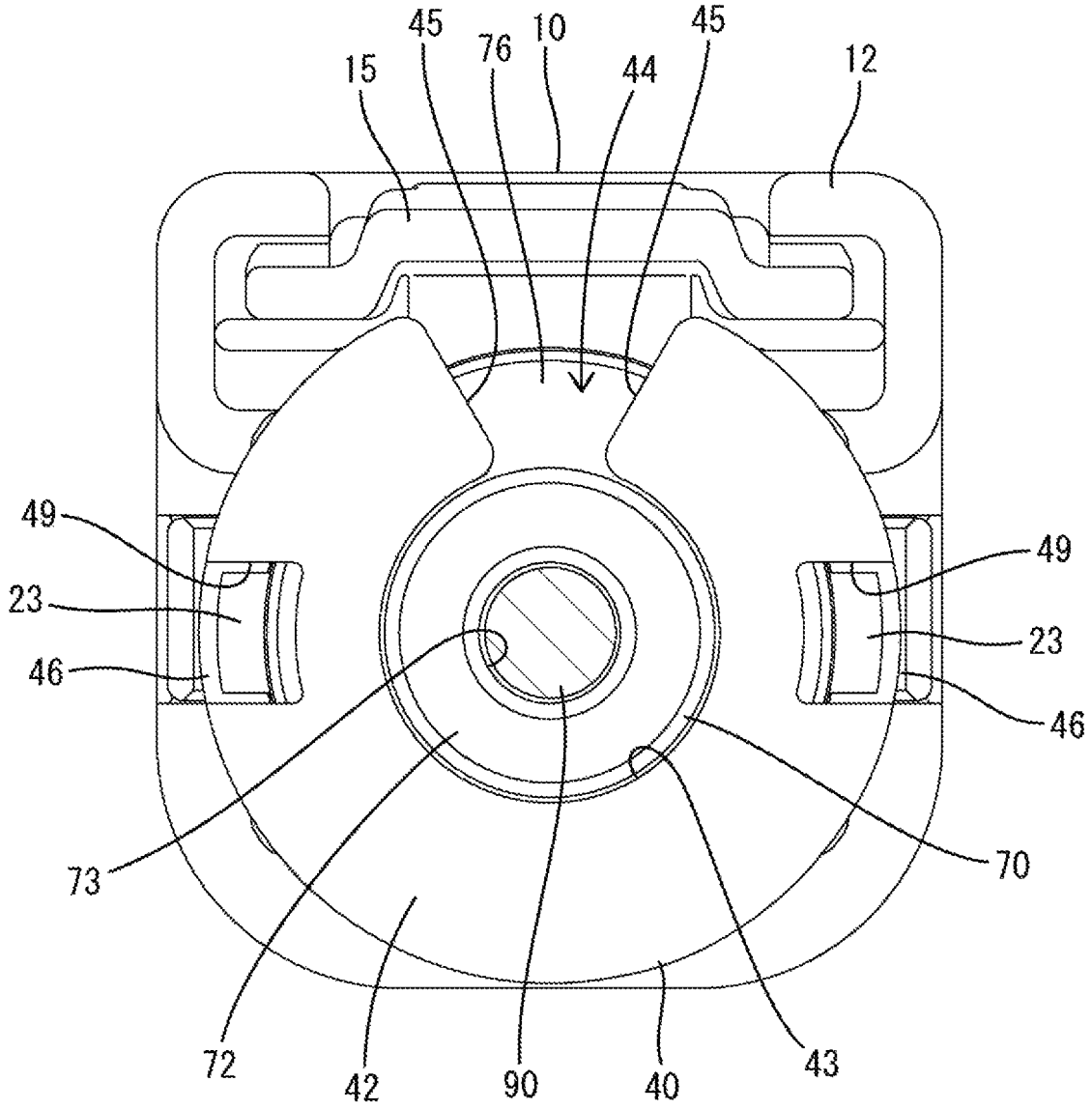
FIG. 3 is a back view of the waterproof connector.
Figure 4:
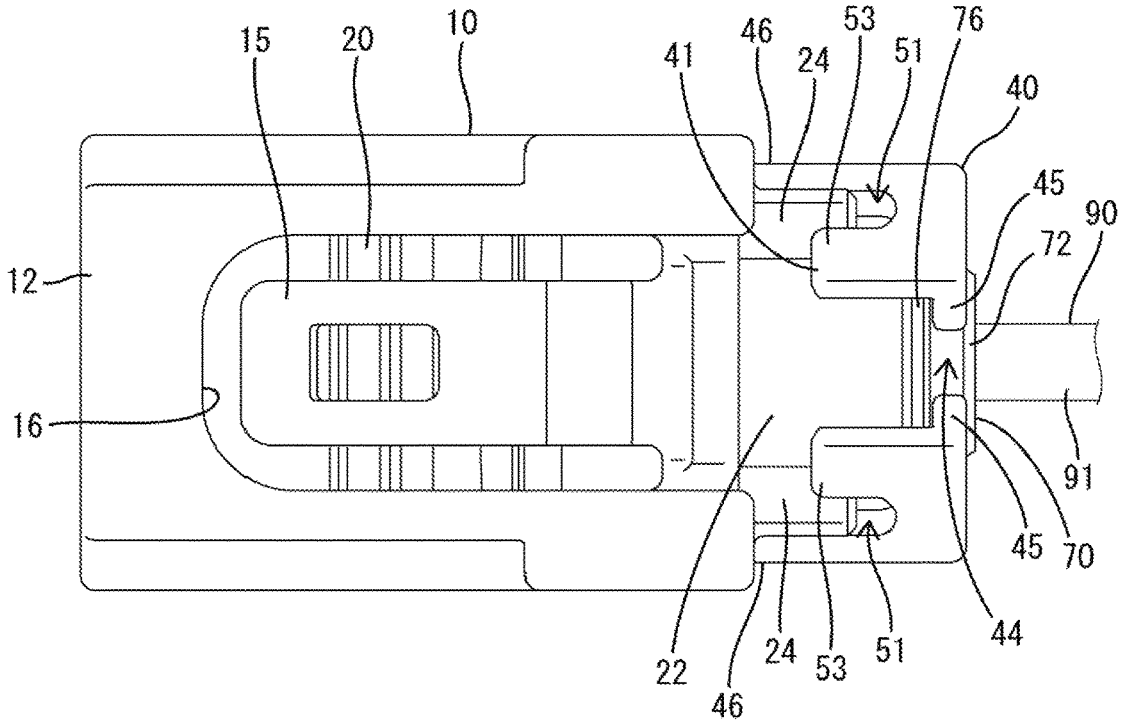
FIG. 4 is a plan view of the waterproof connector.
Figure 12:
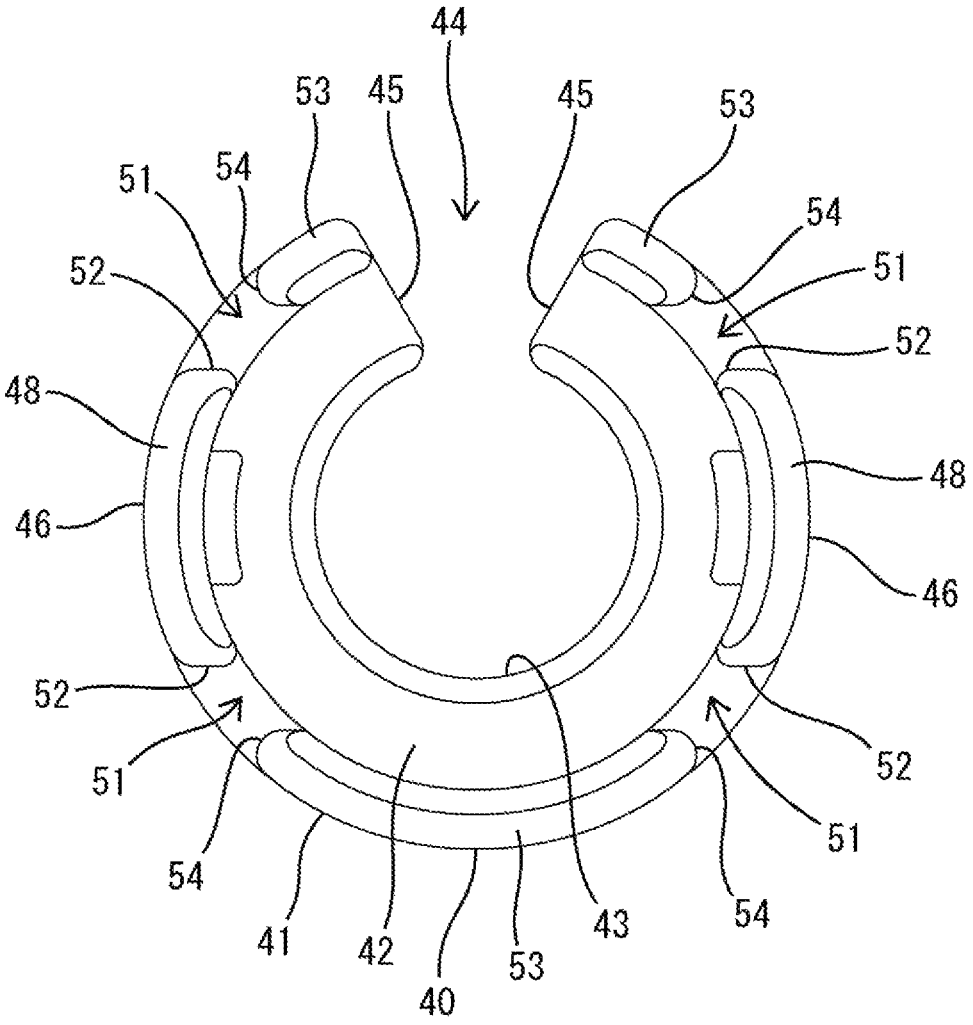
FIG. 12 is a front view of a cover.

The cover 40 is made of synthetic resin and, as shown in FIG. 12, has a substantially hollow cylindrical shape partially open in a circumferential direction as a whole. Specifically, the cover 40 includes a thin peripheral wall portion 41 having inner and outer peripheral surfaces continuous in the circumferential direction, and a thin body portion 42 connected to the rear end of the peripheral wall portion 41 and having front and rear surfaces continuous in the circumferential direction. The body portion 42 includes a wire insertion hole 43 having an arcuate cross-section. As shown in FIG. 3, an opening diameter of the wire insertion hole 43 is sufficiently larger than the outer diameter of the shielded wire 90.

Figure 13:
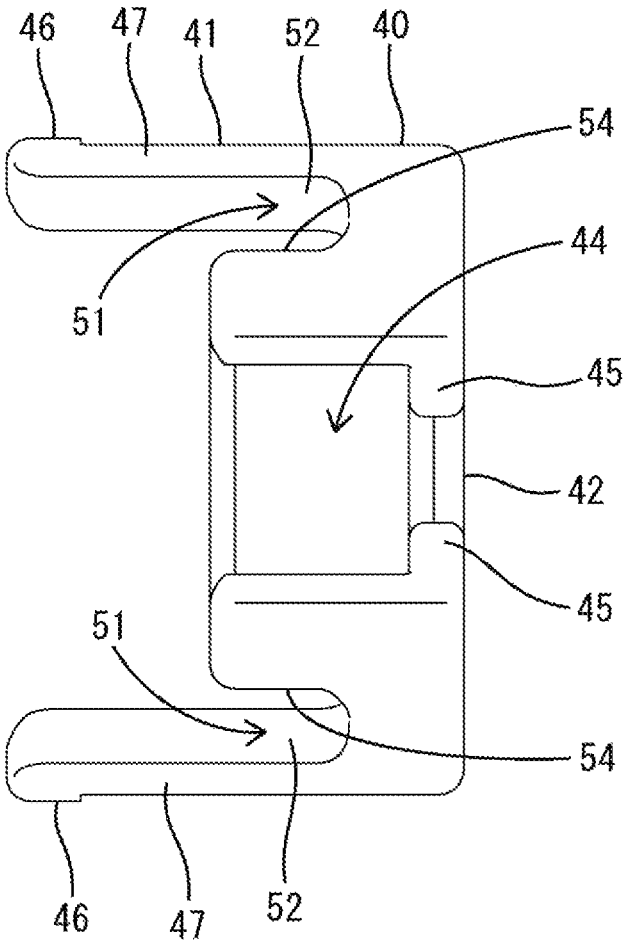
FIG. 13 is a plan view of the cover.

As shown in FIGS. 12 and 13, a wire insertion opening 44 penetrates the cover 40 over the entire length in the front-rear direction from the peripheral wall 41 to the body 42 and is formed by being radially cut from the outer peripheral surface of the peripheral wall 41 to the inner peripheral surface of the wire insertion hole 43 of the body 42. The wire insertion opening 44 has two facing surfaces 45 facing each other on the side of the body 42. As shown in FIG. 12, both facing surfaces 45 inclined to widen an interval (circumferential interval) therebetween from the side of the wire insertion opening 44 (inner peripheral side) to the outer peripheral surface. A minimum width on the inner periphery, out of the interval between the facing surfaces 45, is equal to or slightly smaller than the outer diameter of the shielded wire 90, and a maximum width on the outer periphery is sufficiently larger than the outer diameter of the shielded wire 90 (see FIG. 3). The cover 40 has a substantially C shape in a front view and a back view by including the wire insertion opening 44.

Figure 14:
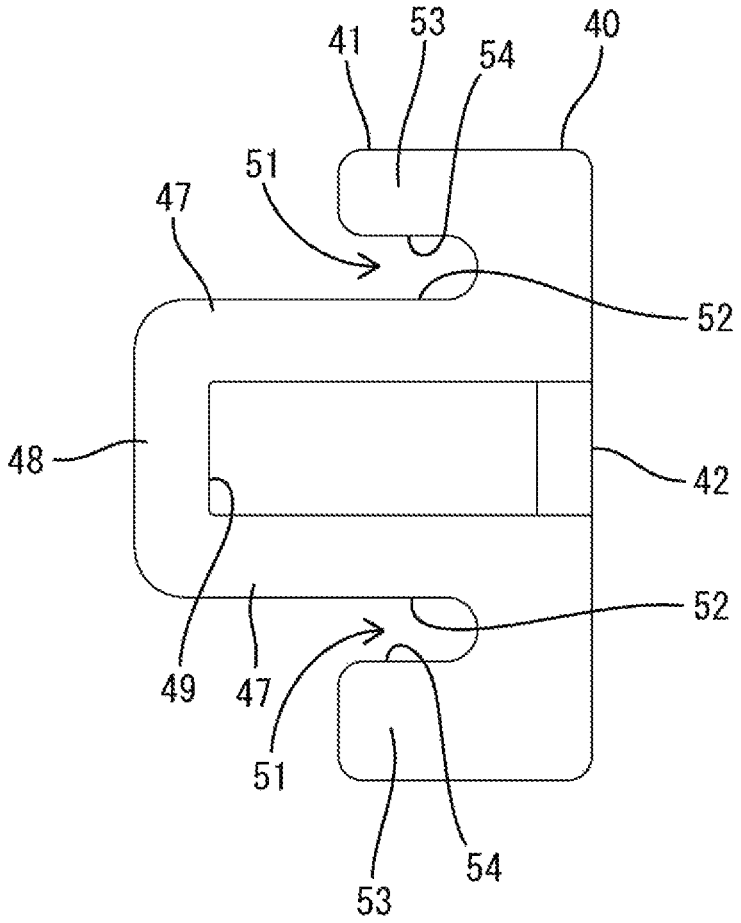
FIG. 14 is a side view of the cover.

As shown in FIGS. 12 and 13, cover locks 46 project forward on left and right sides of the peripheral wall 41. As shown in FIG. 14, each cover lock 46 is a rectangular frame having a curved cross-section, and includes two extending portions 47 extending parallel to each other in the front-rear direction, and a projecting end 48 connects front ends of the extending portions 47. Each cover lock 46 includes a rectangular lock hole 49 defined by the extending portions 47 and the projecting end part 48. Each lock hole 49 extends in the front-rear direction and has a rear end open in the rear surface of the body 42. The projecting end part 48 is arranged vertically and closes the front end of the lock hole 49. The corresponding housing lock 23 is fit into the lock hole 49 of each cover lock 46. The front surface of each housing lock 23 can contact the projecting end part 48 of the lock hole 49 of the corresponding cover lock 46 (see FIG. 5).

As shown in FIGS. 12 to 14, the peripheral wall 41 includes two slit-like grooves 51 recessed rearward into a substantially U shape from the front end on each of the left and right sides. Each groove 51 is defined along the front-rear direction by an outer side edge 52 (edge opposite to an inner side edge defining the lock hole 49) of the extending portion 47 of each cover lock 46 and defined along the front-rear direction by an end 54 of a cover lock holding portion 53 to be described later on a side facing the extending portion 47. A groove width (separation dimension in the vertical direction between the extending portion 47 and the cover lock 53) is equal to or slightly larger than a vertical dimension of the housing lock holding portion 24 (see FIG. 5).

As shown in FIG. 12, the cover lock holding portions 53 are provided on upper and lower sides of the peripheral wall 41. The cover lock holding portion 53 on the lower side of the peripheral wall 41 has a cross-section extending in a curved manner in the circumferential direction and both circumferential end parts define the grooves 51. The cover lock holding portions 53 on the upper side of the peripheral wall 41 are ribs projecting on both circumferential sides, one circumferential end part (end part 54) of each cover lock holding portion 53 defines the groove 51 and the other circumferential end part (upper end part) defines the wire insertion opening 44. In other words, the cover lock holding portions 53 provided on the upper side of the peripheral wall 41 are divided on the left and right sides via the wire insertion opening 44.

Next, functions and effects of this embodiment are described.

In assembling, the terminal fitting 80 connected to the end part of the shielded wire 90 is inserted into the terminal accommodating portion 18 of the housing body 11 from behind. At this time, the shielded wire 90 is inserted through the sealing hole 73 of the rubber plug 70 and the rubber plug 70 is mounted on the shielded wire 90 in advance. On the other hand, the cover 40 is not mounted on the shielded wire 90.

The terminal fitting 80 is accommodated entirely in the terminal accommodating portion 18 of the housing body 11 and the locking projection 82 is locked to the locking lance 21 so that the terminal fitting 80 is held in the terminal accommodating portion 18 (see FIG. 1). Subsequently, the rubber plug body 71 is fit tightly in the rear part of the rubber plug accommodating portion 19. When the rubber plug 70 is inserted properly into the rubber plug accommodating portion 19, the flange 76 contacts the opening peripheral part of the rubber plug accommodating portion 19 on the rear end of the cover mounting portion 22 of the housing body 11 along the circumferential direction. That is, the flange 76 and the projection 72 are arranged to be exposed behind the rear end of the cover mounting portion 22 of the housing body 11. Note that the rubber plug 70 is not in contact with the terminal fitting 80 and is separated from the rear end of the terminal fitting 80.

Subsequently, the cover 40 is displaced radially with respect to the shielded wire 90, and the shielded wire 90 is inserted into the wire insertion hole 43 of the cover 40 through the wire insertion opening 44. At this time, the sheath 91 of the shielded wire 90 can slide in contact with the facing surfaces 45 (inclined surfaces) of the wire insertion opening 44 to guide the insertion of the shielded wire 90 into the wire insertion hole 43. The shielded wire 90 is inserted loosely into the wire insertion hole 43 of the cover 40 and escape from the wire insertion hole 43 is restricted by the shielded wire 90 contacting the minimum width parts on the inner periphery in the facing surfaces 45 of the wire insertion opening 44.

Thereafter, the cover 40 is moved along the shielded wire 90 toward the cover mounting portion 22 of the housing 11. When the peripheral wall 41 of the cover 40 reaches a position to cover the outer periphery of the cover mounting portion 22 of the housing 10, the projecting ends 48 of the cover locks 46 slide in contact with the rear surfaces of the respective housing locks 23 and the cover locks 46 deflect out with the ends thereof on the side of the body 42 as supports. During this time, the housing lock holding portions 24 are fit into the respective grooves 51 of the cover 40, the end parts 54 of the cover lock holding portions 53 and the outer sides 52 of the extending portions 47 of the cover locks 46 slide in contact with the respective housing lock holding portions 24, and the cover 40 is guided along the front-rear direction with respect to the cover mounting portion 22.

Figure 5:
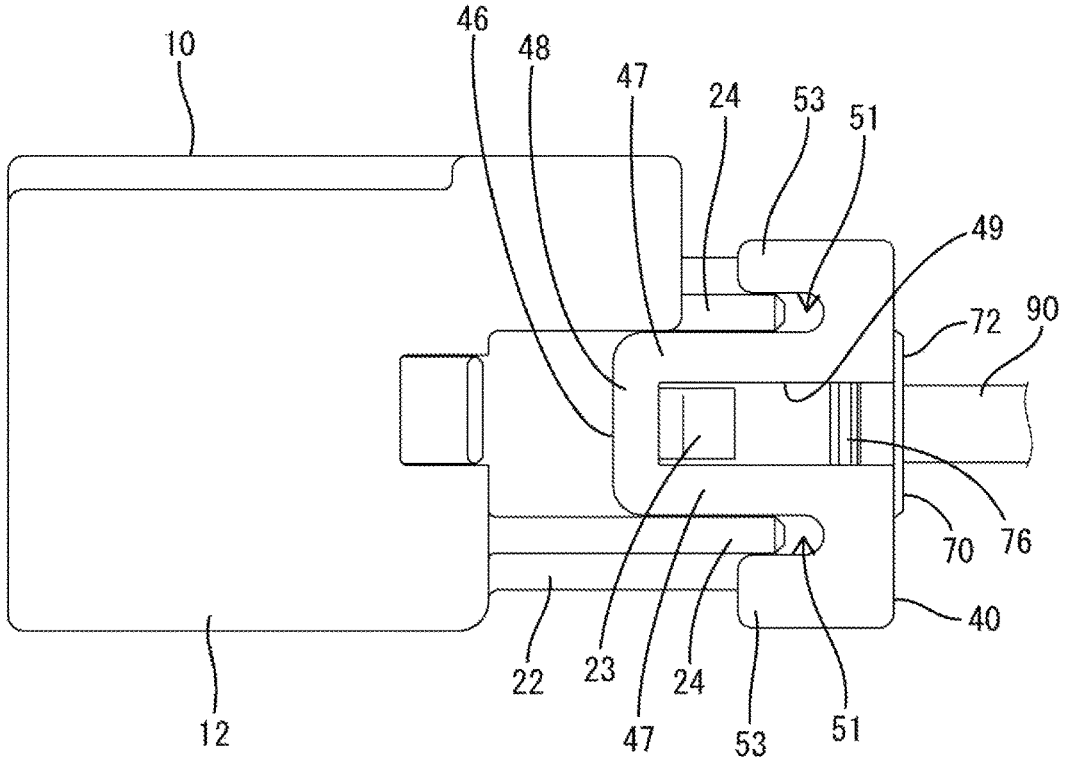
FIG. 5 is a side view of the waterproof connector.
Figure 6:
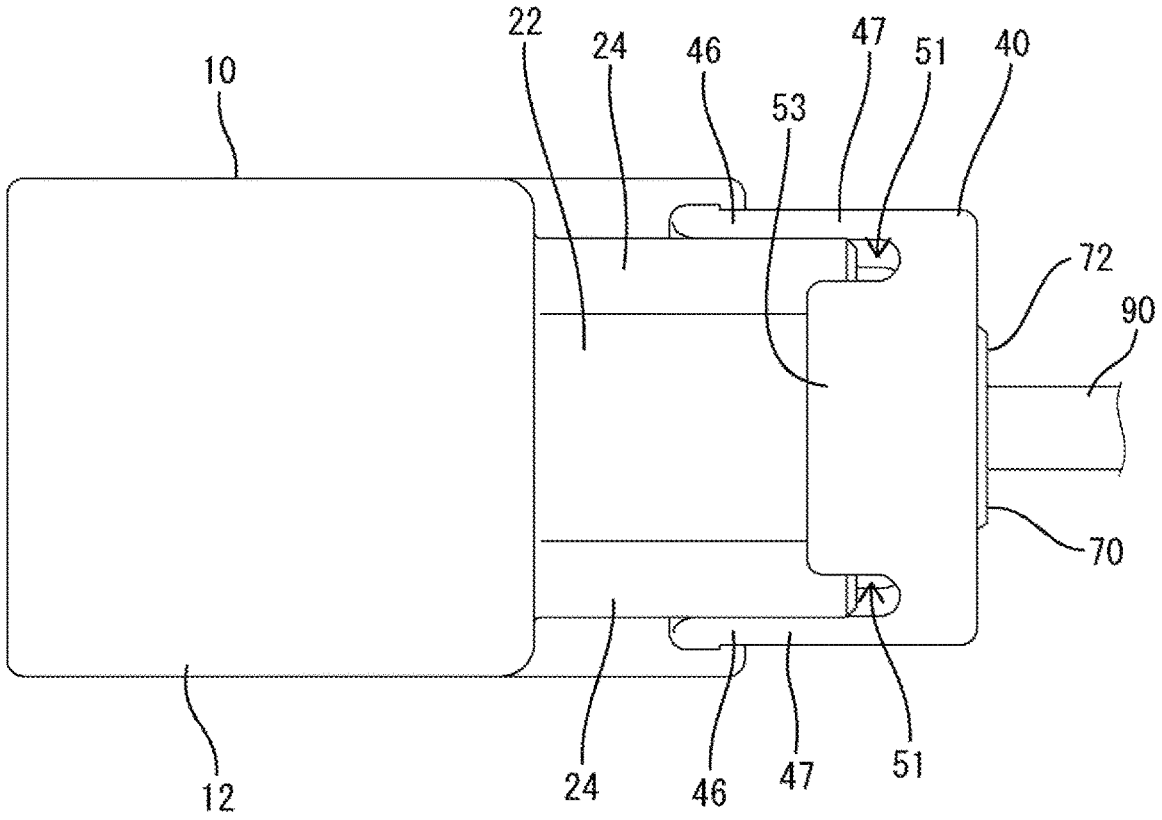
FIG. 6 is a bottom view of the waterproof connector.

When the cover 40 is fit deeply to the cover mounting portion 22, the cover locks 46 resiliently return and the projecting end parts 48 thereof are arranged to contact the front surfaces of the respective housing locks 23 (see FIG. 5). In this way, the cover 40 is held on the cover mounting portion 22 and the escape of the rubber plug 70 from the rubber plug accommodating portion 19 is restricted.

When the cover 40 is mounted properly on the cover mounting portion 22, the body 42 of the cover 40 faces and contacts the rear surface of the rubber plug body 71 and the rear surface of the flange 76. Additionally, the flange 76 is squeezed and sandwiched between the body 42 of the cover 40 and the rear end of the cover mounting portion 22 (see FIG. 1). In this way, a resilient reaction force is applied to the cover 40 from the flange 76 in a direction to separate the cover 40 rearward from the cover mounting portion 22. As a result, a state is reached where the projecting end parts 48 of the respective cover locks 46 are firmly in contact with the front surfaces of the respective housing locks 23 (see FIG. 5) and the separation of the cover 40 from the cover mounting portion 22 is prevented.

Further, when the cover 40 is mounted properly on the cover mounting portion 22, the projection 72 is fit and inserted into the wire insertion hole 43 of the cover 40. At this time, the projection 72 penetrates through the wire insertion hole 43 and the rear end part thereof protrudes rearward from the rear surface of the body 42. Further, the projection 72 is inserted tightly into the wire insertion hole 43 and the outer peripheral surface contacts the inner peripheral surface of the wire insertion hole 43 of the cover 40 (see FIG. 3).

If the shielded wire 90 pulled out rearward (outward) from the sealing hole 73 of the rubber plug 70 vibrates in an assembled state, a force for positionally shifting the respective cover locks 46 in a direction intersecting the front-rear direction with respect to the respective housing locks 23 acts on the cover 40. However, the extending portions 47 of each cover lock 46 contact the corresponding housing lock 23 along the front-rear direction to resist the positional shifting force. Thus, each cover lock 46 remains locked to the corresponding housing lock 23 (see FIG. 5). Further, the housing lock holding portions 24 of the housing 10 are positioned in the respective grooves 51 of the cover 40 and contact the respective cover lock holding portions 53 along the front-rear direction. Thus, the cover locks 46 are locked more reliably to the respective housing lock portions 23.

As described above, according to this embodiment, the cover 40 includes the wire insertion opening 44 formed by cutting a circumferential part between the cover locks 46. Thus, the shielded wire 90 can be inserted into the wire insertion hole 43 of the cover 40 through the wire insertion opening 44 after the terminal fitting 80 is inserted into the terminal accommodating portion 18 of the housing 10, and it is not necessary to perform a cumbersome operation of inserting the shielded wire 90 into the wire insertion hole 43 of the cover 40 in the axial direction. Further, an assembling operation of the cover 40 can be performed in an arbitrary stage. Therefore, assembling efficiency can be improved.

The cover lock 46 includes the lock hole 49 between the two extending portions 47 extending in the front-rear direction (axial direction of the wire insertion hole 43), the housing lock 23 is a projection to fit into the lock hole 49 and the housing 10 includes the housing lock holding portions 24 contacting the extending portions 47 along the front-rear direction. Thus, even if the shielded wire 90 pulled out from the wire insertion hole 43 of the cover 40 vibrates and a vibration force of the wire 90 is transmitted to the cover 40, locking between the cover locks 46 and the housing locks 23 will not release inadvertently.

The cover 40 has the cover lock holding portions 53 that sandwich the housing lock holding portions 24 between the extending portions 47 and the cover lock holding portions 53 and contacting the housing lock holding portions 24 from a side opposite to the extending portions 47. Thus, the cover 40 is held more stably on the housing 10, and a situation where the cover 40 is detached inadvertently from the housing 10 is prevented even more reliably.

The rubber plug 70 includes the radially protruding flange 76 that is sandwiched between the body 42 of the cover 40 and the rear part of the cover mounting portion 22 (opening edge of the rubber plug accommodating portion 19). Thus, a resilient reaction force is applied from the rubber plug 70 to the cover 40 in a direction separating from the housing 10, and the cover locks 46 are locked firmly to the housing locks 23 so that the cover 40 is held even more stably on the housing 10. Further, the flange 76 closely contacts the rear of the cover mounting portion 22 so that high-pressure washing water and the like will not intrude into the rubber plug accommodating portion 19.

The diameter of the wire insertion hole 43 of the cover 40 exceeds the outer diameter of the shielded wire 90. Thus, plural types of wires 90 having different outer diameters can be inserted through the wire insertion hole 43 and the cover 40 can be used commonly.

Furthermore, the facing surfaces 45 on the wire insertion opening 44 of the cover 40 are inclined to widen the interval between the facing surfaces 45 from the side of the wire insertion hole 43 to the outer peripheral surface of the cover 40. Thus, the facing surfaces 45 guide the wire 90 and the insertion of the wire 90 into the wire insertion hole 44 of the cover 40 is performed smoothly.

Other embodiments are briefly described below.

The wire may be a general wire with no shield layer. Further, the terminal fitting may be a general terminal fitting including a barrel to be crimped to a general wire.

Plural terminal accommodating portions may be provided in the housing.

The cover may be formed into a rectangular tube shape.

The cover lock holding portions may be omitted from the cover.

The rubber plug may be entirely accommodated in the rubber plug accommodating portion.

LIST OF REFERENCE SIGNS

10 . . . housing
18 . . . terminal accommodating portion
19 . . . rubber plug accommodating portion
23 . . . housing lock (lock projection)
24 . . . housing lock holding portion
40 . . . cover
42 . . . body
43 . . . wire insertion hole
44 . . . wire insertion opening
45 . . . facing surface (inclined surface)

46 . . . cover lock (lock piece)
47 . . . extending portion
49 . . . lock hole
53 . . . cover lock holding portion
70 . . . rubber plug
72 . . . projection
76 . . . flange
80 . . . terminal fitting
90 . . . shielded wire (wire)

What is claimed is:

1. A waterproof connector, comprising:

a terminal fitting to be connected to an end part of a wire;

a rubber plug to be held in close contact with an outer peripheral surface of the wire;

a housing including a terminal accommodating portion capable of accommodating the terminal fitting, a rubber plug accommodating portion communicating with the terminal accommodating portion and capable of accommodating the rubber plug, and two housing locks on both sides across the rubber plug accommodating portion; and a cover configured to restrict the escape of the rubber plug from the rubber plug accommodating portion and including a wire insertion hole inside;

the cover including two cover locks lockable to the housing locks and a wire insertion opening located between the cover locks and formed by cutting a circumferential part from an outer peripheral surface to the wire insertion hole, wherein:

two facing surfaces on the wire insertion opening of the cover are inclined to widen an interval between the facing surfaces from the side of the wire insertion hole to an outer peripheral surface of the cover.

2. The waterproof connector of claim 1, wherein each of the cover locks has a lock hole between extending portions extending in an axial direction of the wire insertion hole, each of the housing locks is a lock projection to be fit into the lock hole and the housing includes housing lock holding portions capable of respectively coming into contacting the extending portions along the axial direction.

3. The waterproof connector of claim 1, wherein the rubber plug includes a flange protruding in a direction perpendicular to the axial direction, and the cover includes a body (42) configured to sandwich the flange between an opening edge of the rubber plug accommodating portion in the housing and the body.

4. The waterproof connector of claim 1, wherein the wire insertion hole of the cover has an opening diameter larger than an outer diameter of the wire.

5. A waterproof connector, comprising:

a terminal fitting to be connected to an end part of a wire;

a rubber plug to be held in close contact with an outer peripheral surface of the wire;

a housing including a terminal accommodating portion capable of accommodating the terminal fitting, a rubber plug accommodating portion communicating with the terminal accommodating portion and capable of accommodating the rubber plug, and two housing locks on both sides across the rubber plug accommodating portion; and a cover configured to restrict the escape of the rubber plug from the rubber plug accommodating portion and including a wire insertion hole inside, the cover including two cover locks lockable to the housing locks and a wire insertion opening located between the cover locks and formed by cutting a circumferential part from an outer peripheral surface to the wire insertion hole, wherein:

each of the cover locks has a lock hole between extending portions extending in an axial direction of the wire insertion hole, each of the housing locks is a lock projection to be fit into the lock hole, the housing includes housing lock holding portions capable of respectively coming into contacting the extending portions along the axial direction, and the cover includes cover lock holding portions capable of sandwiching the housing lock holding portions between the extending portions and the cover lock holding portions and contacting the housing lock holding portions from a side opposite to the extending portions along the axial direction.

6. The waterproof connector of claim 5, wherein the rubber plug includes a flange protruding in a direction perpendicular to the axial direction, and the cover includes a body configured to sandwich the flange between an opening edge of the rubber plug accommodating portion in the housing and the body.

7. The waterproof connector of claim 6, wherein the wire insertion hole of the cover has an opening diameter larger than an outer diameter of the wire.

8. The waterproof connector of claim 7, wherein two facing surfaces on the wire insertion opening of the cover are inclined to widen an interval between the facing surfaces from the side of the wire insertion hole to an outer peripheral surface of the cover.

* * * * *